US007313844B2

(12) United States Patent
Petner et al.

(10) Patent No.: US 7,313,844 B2
(45) **Date of Patent: *Jan. 1, 2008**

(54) TRASH RECEPTACLE CLEANING PRODUCT

(75) Inventors: Robert E. Petner, Burlington, NJ (US); Charles E. Gengler, South Orange, NJ (US)

(73) Assignee: Nice Life, Inc., Burlington, NJ (US)

( * ) Notice: Subject to any disclaimer, the term of this patent is extended or adjusted under 35 U.S.C. 154(b) by 25 days.

This patent is subject to a terminal disclaimer.

(21) Appl. No.: 11/291,573

(22) Filed: Dec. 1, 2005

(65) Prior Publication Data

US 2007/0124889 A1 Jun. 7, 2007

(51) Int. Cl.
*B65D 25/24* (2006.01)
*A47L 13/52* (2006.01)

(52) U.S. Cl. ..... 15/257.2; 15/257.1; 220/908

(58) Field of Classification Search .... 15/257.1–257.3, 15/257.6–257.7; 220/501, 531, 908, 908.3, 220/630, 628, 633, 636, 635, 631
See application file for complete search history.

(56) References Cited

U.S. PATENT DOCUMENTS

| | | | | |
|---|---|---|---|---|
| 2,676,728 | A * | 4/1954 | Smith | 220/503 |
| 2,789,723 | A * | 4/1957 | Perez | 220/561 |
| 4,785,964 | A * | 11/1988 | Miller et al. | 220/263 |
| 5,473,790 | A * | 12/1995 | Desmarais | 15/257.7 |
| 5,611,450 | A * | 3/1997 | DeMars | 220/212 |
| 2003/0037399 | A1 * | 2/2003 | Biggs | 15/257.2 |

* cited by examiner

*Primary Examiner*—Shay Karls
(74) *Attorney, Agent, or Firm*—Stuart M. Goldstein

(57) ABSTRACT

A trash receptacle cleaning product has a trash receiving receptacle with side walls and a bottom wall. Side walls of the container extend past the bottom wall, forming a base for the container and a partially enclosed space below the bottom wall of the container. The front wall of the container has a cut-out or indented section configured to accept and store the handle of a cleaning implement, such as a lobby dustpan and broom unit. The space beneath the bottom wall permits the insertion of the lower part of the cleaning implement within the space. The result is a compact, self-contained trash cleaning product which can easily and conveniently be transported for use to any given location for cleaning and sweeping.

4 Claims, 3 Drawing Sheets

TRASH RECEPTACLE CLEANING PRODUCT

BACKGROUND OF THE INVENTION

The process of sweeping and cleaning a floor surface normally involves the use of a broom or similar cleaning tool, a lobby dustpan or similar disposal tool, and the trash can or receptacle into which the dirt, trash and debris is placed. Most often, when cleaning is required, these three components are found in different locations, compelling the user to first retrieve the broom and locate the dustpan, then seek out the trash receptacle and finally transport all these components to the soiled location in order to dispose of the gathered dirt and debris. The prior art fails to show a cleaning tool/trash receptacle which simply and practically combines and stores cleaning components for efficient cleaning with the ease and convenience of use.

SUMMARY OF THE INVENTION

It is therefore the object of the present invention to overcome the limitations and disadvantages of the prior art.

It is the object of the present invention to provide a trash cleaning product which employs a trash receptacle configured to store cleaning implements.

It is another object of the present invention to provide a trash cleaning product which effectively combines a separate sweeping or cleaning implement, a lobby dustpan or similar disposal tool, and a trash receptacle to form a single unit.

It is a further object of the present invention to provide a trash cleaning product which permits the user to store all cleaning implements for sweeping and cleaning as a single product, at a single location.

It is still another object of the present invention to provide a trash cleaning product which is compact and provides for ready access of cleaning implements at one location.

It is a further object of the present invention to provide a trash cleaning product which allows for easy removal and replacement of implements into a single unit.

These and other objects are accomplished by the present invention, a trash receptacle cleaning product comprising a trash receiving receptacle having side walls and a bottom wall. Side walls of the container extend past the bottom wall, forming a base for the container and a partially enclosed space below the bottom wall of the container. The front wall of the container has a cut-out or indented section configured to accept and store the handle of a cleaning implement, such as a lobby dustpan and broom unit. The space beneath the bottom wall permits the insertion of the lower part of the cleaning implement within the space. The result is a compact, self-contained trash cleaning product which can easily and conveniently be transported for use to any given location for cleaning and sweeping.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

DETAILED DESCRIPTION OF THE INVENTION

Figure 1:
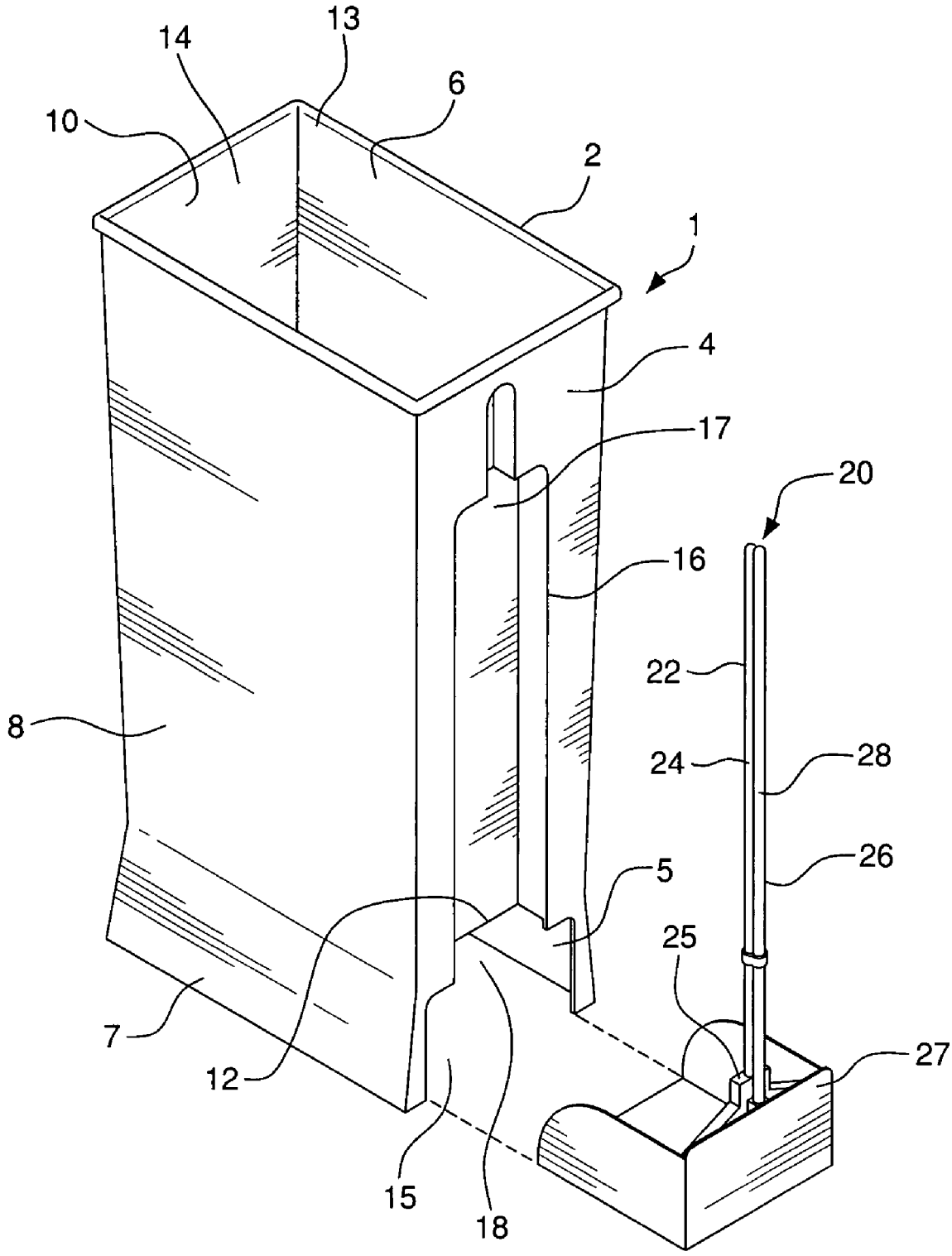
FIG. 1 is an isometric view of the trash receptacle cleaning product of the present invention with the components shown separated.
Figure 2:
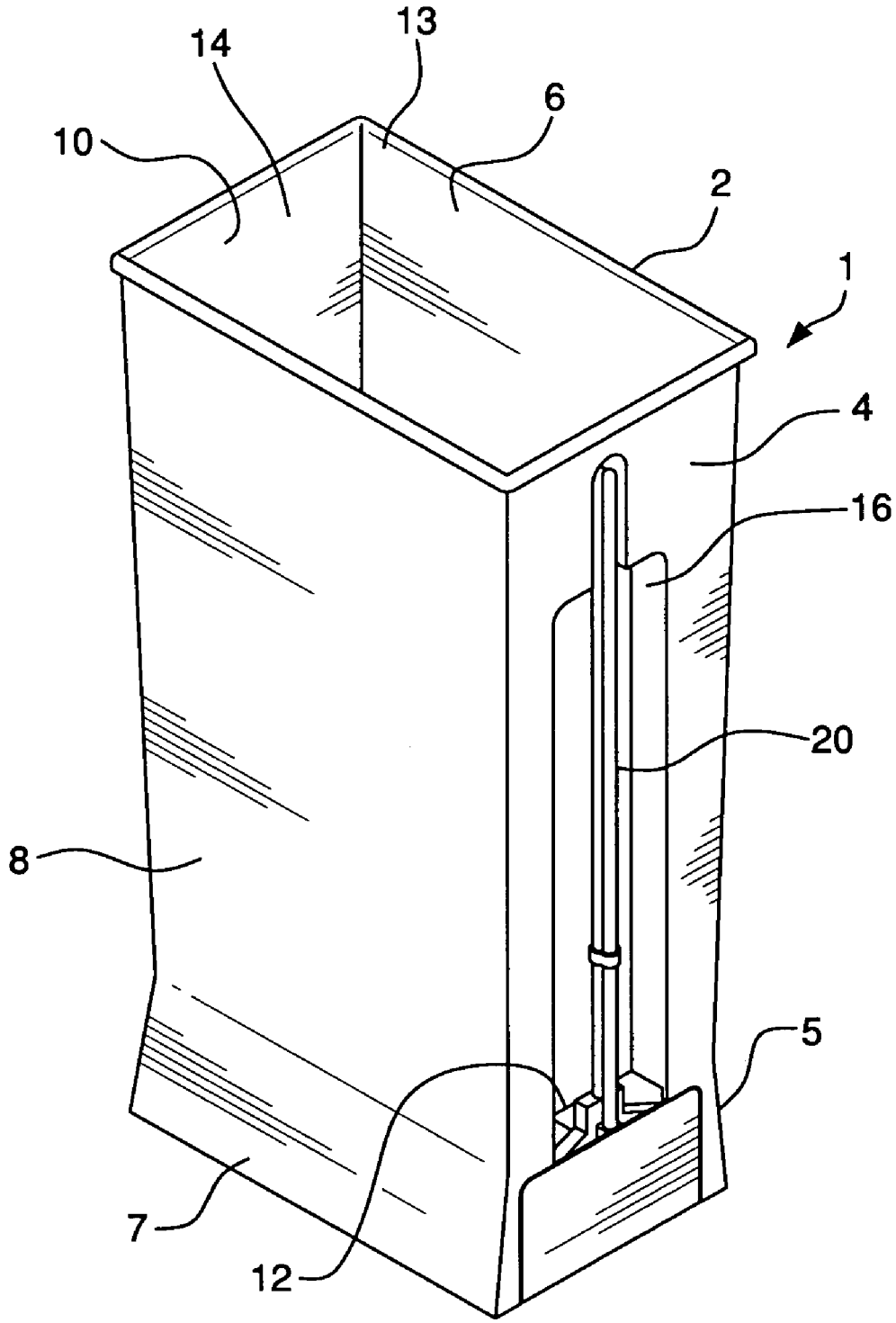
FIG. 2 is an isometric view of the trash receptacle cleaning product of the present invention with its components in place.
Figure 3:
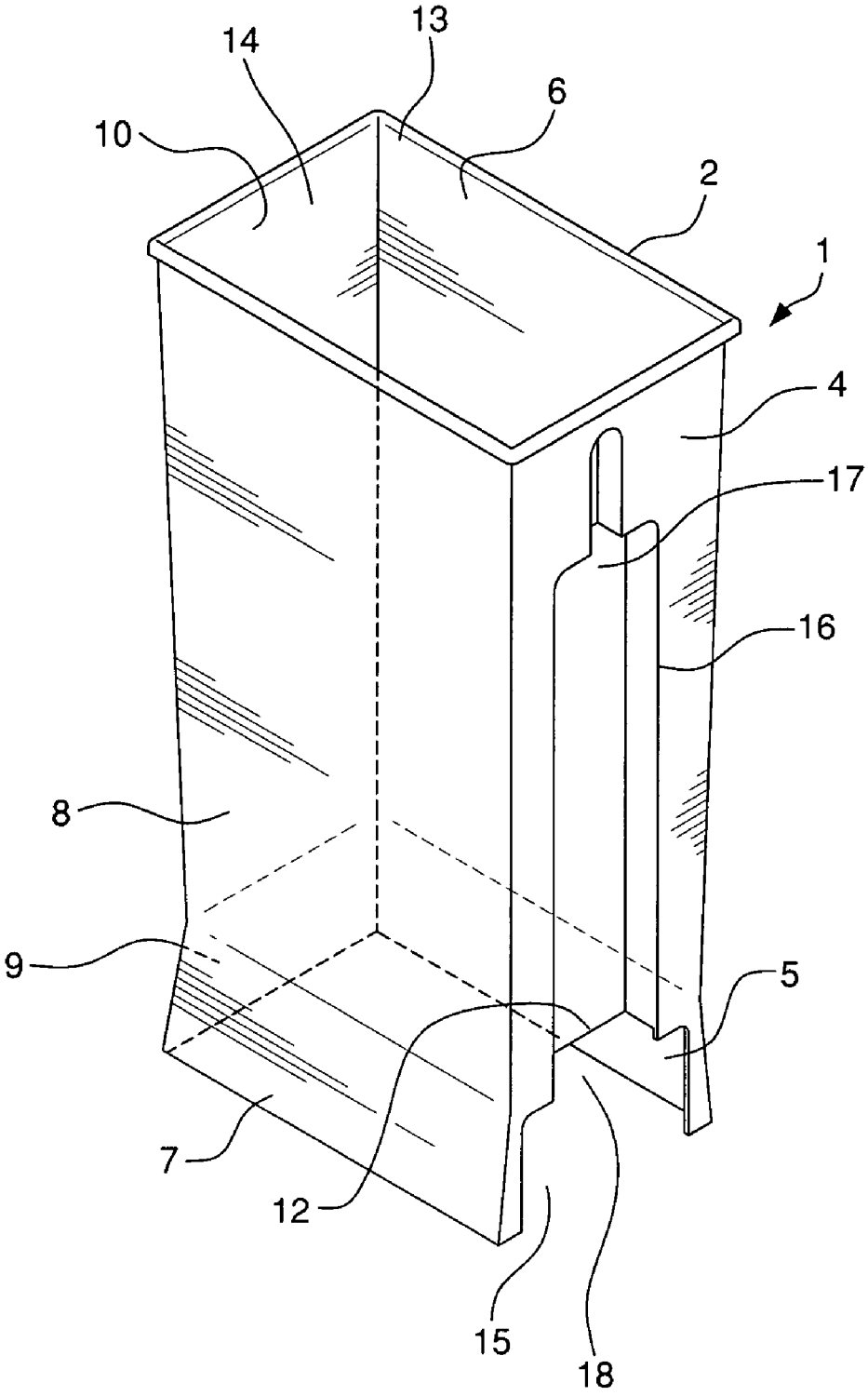
FIG. 3 is an isometric view of the container of the receptacle cleaning product of the present invention.

Trash receptacle product system 1 of the present invention comprises container 2 and cleaning implement 20. Container 2 has front wall 4, side walls 6, 8, and 10, and bottom wall 12. These walls encompass enclosure 13, with trash receiving opening 14 which accepts trash placed into container 2. Side walls 6, 8, and 10 extend downward from opening 14, past bottom wall 12 as leg members 5, 7, and 9 respectively. These leg members, comprising the lower sections of sidewalls 6, 8, and 10, form the base for container 2. As shown in FIGS. 1-3, leg members 5, 7, and 9 may be flared outward to provide added stability to container 2. Lower space 18, partially enclosed by side walls 6, 8, and 10, is thus formed beneath bottom wall 12. Opening 15 provides access to space 18.

Front wall 4 comprises cut-out or indented section 16. Back wall 17 of section 16 limits the inward dimension of the cut-out area. Section 16 is configured to accept and store cleaning implement 20, such as a lobby dustpan/broom cleaning unit. Such cleaning units routinely comprise handle 24 of broom 22 aligned and removeably secured to handle 28 of dustpan component 26. Broom head 25 of broom 22 is positioned within lower dustpan section 27 of dustpan component 26. Handles 24 and 28 of cleaning implement 20 are thus readily positioned within section 16 and lower dustpan section 27, with broom head 25 therein, is inserted through opening 15 and into space 18, for easy storage.

It can thus readily be appreciated that trash receptacle product system 1 of the present invention provides a compact, self-contained cleaning unit. It is a most convenient and efficient means to store a cleaning implement directly with the very trash receptacle into which dirt, trash and debris gathered by the implement will be placed. The cleaning implement of the system can easily and simply be removed from its trash receptacle and then returned to its stored position. When clean-up at a given location is necessary, the entire trash receptacle product system can be transported to that location, where all necessary components for the clean-up are immediately available.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A trash cleaning product comprising:

a cleaning implement with an elongated handle and lower lobby dustpan section;

a container having a front wall, a plurality of side walls with transversely extending widths, and a horizontally extending bottom wall, said bottom wall comprising the lowermost horizontal wall of the product, said front, side and bottom walls encompassing a trash receiving enclosure;

one leg member extending downwardly from and traversing the full width of each of the plurality of side walls, the leg members being adjacent to each other to form a base extending substantially around the container, below the bottom wall, each leg member having an upper end adjacent to the side wall and a lowermost end forming the bottom of the base, the upper end and the lower end having a constant height, wherein the height is defined as the distance between the upper and lower ends of the leg members;

a storage space located directly beneath the bottom wall extending from directly below the bottom wall to the lowermost end of each leg member, said storage space being enclosed within the base by the bottom wall, the leg members and the front wall and having an open bottom; and inset means within the front wall for storage of the handle of the cleaning implement within the inset means of the front wall and an opening located through the front wall leading into the storage space, said opening extending from the inset means downward to the lowermost end of the side walls and the bottom of the base and being shaped to accept the dustpan section for storage within the storage space beneath the bottom wall when the handle is stored in the inset means.

2. The trash cleaning product as in claim 1 wherein the inset means comprises upper and lower inset sections, the upper section being smaller than the lower section and being configured to surround the handle.

3. The trash cleaning product as in claim 1 wherein the inset means comprises an elongated space cut-out from said front wall.

4. The trash cleaning product as in claim 1 wherein the lobby dustpan section is configured substantially like the shape of the opening, such that when the dustpan section of the cleaning implement is stored within the space, the opening is closed and the space is fully enclosed.

* * * * *